United States Patent [19]

Sharrah

[11] Patent Number: 4,777,582

[45] Date of Patent: Oct. 11, 1988

[54] MICRO-FLASHLIGHT

[75] Inventor: Raymond L. Sharrah, Collegeville, Pa.

[73] Assignee: Streamlight, Inc., Norristown, Pa.

[21] Appl. No.: 97,200

[22] Filed: Sep. 16, 1987

[51] Int. Cl.[4] ..... F21L 7/00

[52] U.S. Cl. ..... 362/205; 362/157; 362/202

[58] Field of Search ..... 362/157, 205, 202, 203, 362/204, 188, 197, 178

[56] References Cited

U.S. PATENT DOCUMENTS

| | | | |
|---|---|---|---|
| 1,584,539 | 5/1926 | Hopkins . | |
| 1,680,169 | 8/1928 | Osean . | |
| 2,016,819 | 10/1935 | Meginniss | 240/10.66 |
| 2,097,222 | 10/1937 | Thompkins et al. | 240/10.66 |
| 2,173,650 | 9/1939 | Fullmer | 240/10.66 |
| 2,259,106 | 10/1941 | Hager | 200/60 |
| 2,339,356 | 1/1944 | Sachs | 240/10.69 |
| 2,490,830 | 12/1949 | Norton | 240/10.68 |
| 2,599,295 | 6/1952 | Thomas | 200/60 |
| 2,736,793 | 2/1956 | Raymond | 362/203 |
| 2,915,621 | 12/1959 | Garland | 240/10.66 |
| 2,931,005 | 3/1960 | Saurwein et al. | 339/182 |
| 2,945,944 | 7/1960 | Gillespie | 240/10.68 |
| 3,737,649 | 6/1973 | Nelson et al. | 240/6.42 |
| 3,829,676 | 8/1974 | Nelson et al. | 240/10.6 |
| 4,060,723 | 11/1977 | Nelson | 362/205 |
| 4,092,580 | 5/1978 | Prinsze | 320/2 |
| 4,114,187 | 9/1978 | Uke | 362/158 |
| 4,151,583 | 4/1979 | Miller | 362/205 |
| 4,171,534 | 10/1979 | Strowe | 362/183 |
| 4,203,150 | 5/1980 | Shamlian | 362/183 |
| 4,234,913 | 11/1980 | Ramme | 362/158 |
| 4,261,026 | 4/1981 | Bolha | 362/101 |
| 4,286,311 | 8/1981 | Maglica | 362/202 |
| 4,329,740 | 5/1982 | Colvin | 362/184 |
| 4,357,648 | 11/1982 | Nelson | 362/183 |
| 4,388,673 | 6/1983 | Maglica | 362/205 |
| 4,398,238 | 8/1983 | Nelson | 362/187 |
| 4,429,351 | 1/1984 | Petzl et al. | 362/187 |
| 4,472,766 | 9/1984 | Hung | 362/158 |
| 4,495,551 | 1/1985 | Foltz | 362/205 |
| 4,531,178 | 7/1986 | Uke | 362/158 |
| 4,577,263 | 1/1986 | Maglica | 362/187 |
| 4,581,686 | 4/1986 | Nelson | 362/204 |
| 4,656,565 | 4/1987 | Maglica | 362/187 |
| 4,658,336 | 4/1987 | Maglica | 362/203 |

FOREIGN PATENT DOCUMENTS

| | | |
|---|---|---|
| 138873 | 10/1950 | Australia . |
| 595051 | 3/1960 | Canada . |
| 2372382 | 6/1978 | France . |
| 839828 | 5/1952 | Fed. Rep. of Germany . |
| 411218 | 6/1934 | United Kingdom . |
| 549104 | 11/1942 | United Kingdom . |
| 812980 | 5/1959 | United Kingdom . |
| 1103071 | 2/1968 | United Kingdom . |

OTHER PUBLICATIONS

Radio Shack, 1987 Catalog, p. 123 Copies Enclosed, Note 3-Section Halogan Flashlight.

Mini-Mag Lite Brochure (1987).

(List continued on next page.)

*Primary Examiner*—Raymond A. Nelli

*Attorney, Agent, or Firm*—Dann, Dorfman, Herrell and Skillman

[57] ABSTRACT

A hand-held, focusable beam flashlight has a barrel portion, a head unit, and a socket/switch assembly coupling the head unit to the barrel portion. The barrel portion has only one open end, thus eliminating the need for a tail cap. The socket/switch assembly is mounted on the open end of the barrel and retains one or more power cells therein. The switching mechanism is independent of the force necessary to maintain the power cell in electrical contact with the socket/switch assembly. The head unit is formed to controllably translate axially relative to the socket/switch assembly. The head unit includes means mechanically coupled to the switching mechanism whereby the electrical circuit to the flashlight bulb may be switched off and on as the head unit translates along the socket/switch assembly. The switching mechanism has essentially no slack, and therefore switching occurs with only a small axial movement of the head unit.

9 Claims, 4 Drawing Sheets

OTHER PUBLICATIONS

Vari-Probe Code Four Adaptor Brochure (undated).
Lumilite Brochure (1986).
Pro-Lite Brochure (undated).
Sigmalite Brochure (1987).
Goldberg Brochure-Catalog Page Including "Tekna" Flashlight, "Techna" Mini-Flashlight, "Micro-Lite", and "Waterproof Diving Beam".
SabreLite System 2000 Brochure (undated).
Luma-Tech 4 Brochure (1/5/81).
Pharo-Tech Brochure (undated).
Code 4 Jr. Brochure (undated) G. T. Price "New Products".
Yuasa Ultlight Brochure (undated).
Excalibre Brochure (1986) Streamlight Rechargeables.

MICRO-FLASHLIGHT

BACKGROUND OF THE INVENTION

This invention relates generally to flashlights, and in particular, to a hand-held, focusable beam flashlight having an improved switching mechanism.

Flashlights of the type including a barrel portion and a head unit which is threaded onto the barrel portion are known in the art. Such flashlights are powered by two or more drycell batteries connected in series within the barrel portion. In conventional flashlights of this type, the barrel portion includes a tail cap at one end which must be removed in order to replace the batteries. The other end of the barrel portion includes a switching mechanism for making and breaking the electrical circuit from a battery terminal, through a lip on the barrel portion to the flashlight bulb.

The switching end of the barrel is threaded externally in order to mate with an internal thread in the head unit. A movable contact on the switching mechanism is brought into contact with or displaced from the lip in the switch end of the barrel.

The head unit includes a parabolic reflector which has a central opening through which the flashlight bulb may pass as the head is threaded onto the barrel. As the head unit is further threaded onto the barrel, the parabolic reflector butts up against and displaces the movable contact to break the electrical circuit between the battery terminal and the flashlight bulb. Rotation of the head in the opposite direction, i.e. unthreading of the head, causes the electrical circuit to be re-established by permitting the movable contact to re-contact the lip.

Conventional flashlights of this type have a number of inherent disadvantages. For example, the removable tail cap is required in order to install and replace batteries in the flashlight barrel, since the switching mechanism in such flashlights is not removable. Consequently, additional machining is required to fabricate such flashlights, thus increasing the fabrication cost. Also, an additional seal is required at the tail cap in order to maintain watertightness of the flashlight.

The batteries in such flashlights are held in contact with the switching mechanism by a stiff coil spring located at the tail end of the flashlight. In order to break the electrical circuit, the force of this spring, which is substantial, must be overcome. Thus, a metal-to-metal thread is required in order to withstand the force necessary to overcome the spring. Also, the switching mechanisms associated with such flashlights inherently have a large amount of slack between the movable contact and the lip. Such an arrangement reduces the speed of circuit connection and disconnection. Furthermore, the switch assembly in the known flashlights is not easily removable for replacement if broken or damaged because it is retained by the lip formed in the switch end of the barrel.

SUMMARY OF THE INVENTION

Accordingly, it is a principal object of this invention to provide a small hand-held flashlight in which the switching of the electrical circuit is unrelated to the force necessary to maintain the batteries in contact with the switching mechanism.

A further object of this invention is to provide such a flashlight having a switching mechanism by which the electrical circuit is connected and disconnected more quickly than in conventional flashlights of this type.

Yet another object of this invention is to provide a small hand-held flashlight in which the switch assembly is easily removed and replaced.

A further object of this invention is to provide such a flashlight having a barrel portion with one permanently closed end.

Another object of this invention is to provide such a small flashlight having fewer seals than known flashlights.

The above and other objects are achieved in a small hand-held flashlight which includes a barrel having only one open end, a socket/switch assembly which holds a flashlight bulb and is mounted for removal and replacement in the open end of the barrel, and a head unit which is formed to engage with the socket/switch assembly in such a way that it can be controllably translated relative to the socket/switch assembly. The socket/switch assembly includes a spring formed of an electrically-conductive material, a stationary contact disposed within the socket/switch assembly adjacent to one end of the spring, and means for retaining the spring in the socket/switch assembly such that the spring is urged toward the stationary contact so as to normally make electrical connection therewith. The stationary contact is connected to an electrode of the flashlight bulb. The socket/switch assembly also includes an elongated plunger which traverses through the body of the socket/switch assembly. The plunger has one end adapted to abut the spring such that as the plunger is displaced it engages and displaces the spring to break the electrical connection between the spring and the stationary contact. The other end of the plunger protrudes or projects from the socket/switch assembly adjacent the lightbulb so that it may be displaced upon actuation of the head unit.

The head unit includes a lens and a substantially parabolic reflector having a central opening to permit the flashlight bulb to pass therethrough when the head unit is engaged with the socket/switch assembly. The central opening is circumscribed by a collar having an annular surface which faces the socket/switch assembly and is dimensioned and positioned to register with said plunger when the head unit is engaged with the socket/-switch assembly. As the head unit is translated axially relative to the socket/switch assembly, it displaces the plunger, which in turn, displaces the spring means to break the electrical connection between the stationary contact and the spring. When the head unit is translated in the opposite direction, electrical connection between the spring and the stationary contact is re-established. In this manner, the flashlight bulb is switched on and off by simple axial displacement of the head unit relative to the socket/switch assembly.

BRIEF DESCRIPTION OF THE DRAWINGS

The foregoing summary, as well as the following detailed description of a preferred embodiment of the present invention, will be better understood when read in conjunction with the appended drawings, in which.

DETAILED DESCRIPTION OF THE PREFERRED EMBODIMENT

Figure 1:
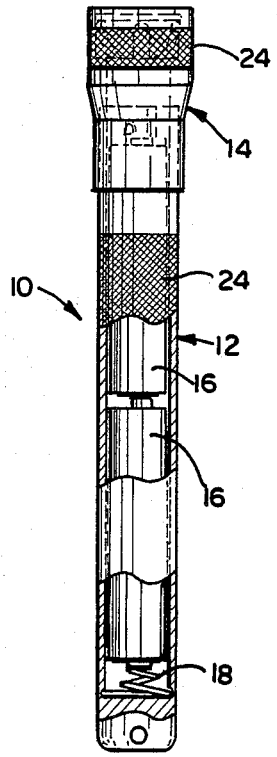
FIG. 1 is a partially cutaway view of a double power cell embodiment of the present invention.

Referring now to the drawings wherein like reference numerals refer to identical or corresponding parts across the several views and in particular to FIG. 1, there is shown generally an assembled flashlight 10 according to the invention. The flashlight 10 includes an elongated barrel 12 and a head unit 14. The elongated barrel 12 has only one open end, the integral tail end being permanently closed off. The elongated barrel 12 has sufficient length to contain a pair of power cells 16. A socket/switch assembly 30 (not shown in FIG. 1) couples the barrel 12 to the head unit 14. A spring 18 is located in the tail end of the elongated barrel 12. Spring 18 biases the power cells 16 into strict contact with the socket/switch assembly 30 which is mounted on the open end of barrel 12. Knurling 24 is provided on the barrel 12 and the head unit 14 in order to make the flashlight easier to handle.

Figure 2:
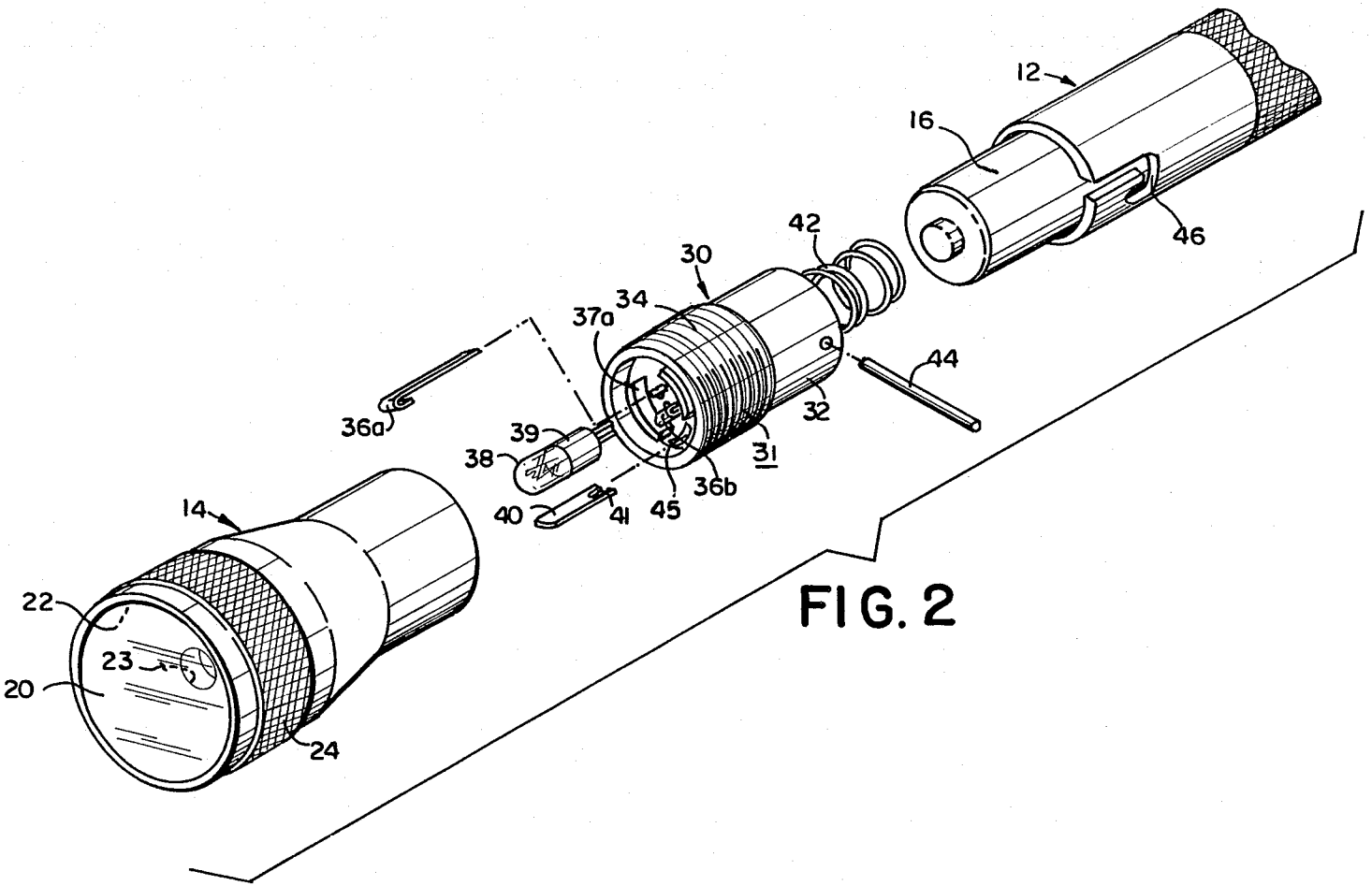
FIG. 2 is a fragmentary exploded view of a flashlight embodying the present invention.

The arrangement of the barrel 12, the head unit 14, and the socket/switch assembly 30 is shown more clearly in FIG. 2. The head unit 14 includes a transparent lens 20 which is preferably snap-fit into the head unit 14. A substantially parabolic reflector 22 is mounted inside the head unit 14 and is held in place by the lens 20. Parabolic reflector 22 has a central opening 23 through which a flashlight bulb 38 passes when the head unit 14 is assembled to the socket/switch assembly 30.

Socket/switch assembly 30 has a generally cylindrical body 31 having a substantially cylindrical portion 32 and an externally threaded portion 34. The forward end of body 31 has a cylindrical hollow **34*a* to receive the bulb 38. A pair of spring contacts 36*a*, 36*b* are located in recesses 37*a*, 37*b*, respectively, which are formed in the forward end of body 31. The recesses 37*a*, 37*b* are arranged to receive the base 39 of a flashlight bulb 38 such that the contacts 36*a*, 36*b* are brought into electrical connection with the terminals of the flashlight bulb 38. In the embodiment shown in FIG. 2, the flashlight bulb 38 is a bi-pin lamp. However, other types of bulb bases, for example a threaded base or a bayonet-type base, could be utilized. In such other case, the recess would be appropriately configured and the contacts 36*a*, 36*b*** would be arranged to accommodate such other bulb bases.

The socket/switch assembly also includes an elongated plunger 40 having a bifurcated end 41. The plunger 40 traverses through the body 31 of the socket/switch assembly 30 in a channel 45 extending from the hollow **34*a* at the forward end of the body to an annular hollow 32*a* formed by a central stem 33 within the cylindrical portion 32** as will be more fully described hereinbelow.

A coil spring 42 is mounted inside the annular hollow **32*a* of the cylindrical portion 32 of socket/switch body 31 and is retained there in slight compression by a retaining pin 44 disposed diametrically of the body 31. The retaining pin 44 has a length which is substantially equal to the outer diameter of the elongated barrel 12. The cylindrical portion 32 of the socket/switch body 31 has a diameter which is smaller than the inside diameter of barrel 12 and the length of the pin 44. Thus, when in place, the ends of the retaining pin 44 project radially outward from the cylindrical portion 32**.

A pair of J-shaped notches 46 are provided to form bayonet slots in the barrel 12 adjacent the open end. The offset portions of the J-shaped notches 46 are oriented in the same circumferential direction. When the power cells 16 are installed in the barrel 12, the socket/switch assembly 30 is mounted on the open end of the barrel 12 by inserting the ends of retaining pin 44 into the J-shaped notches 46 and slightly twisting the socket/switch assembly 30 until the ends of the retaining pin 44 are locked in the J-shaped notches 46. This bayonet-type mount is the preferred means for mounting the socket/switch assembly 30 in the barrel 12 for quick and easy removal and replacement. However, other arrangements may be utilized, for example a threaded configuration.

Figures 3, 3A:
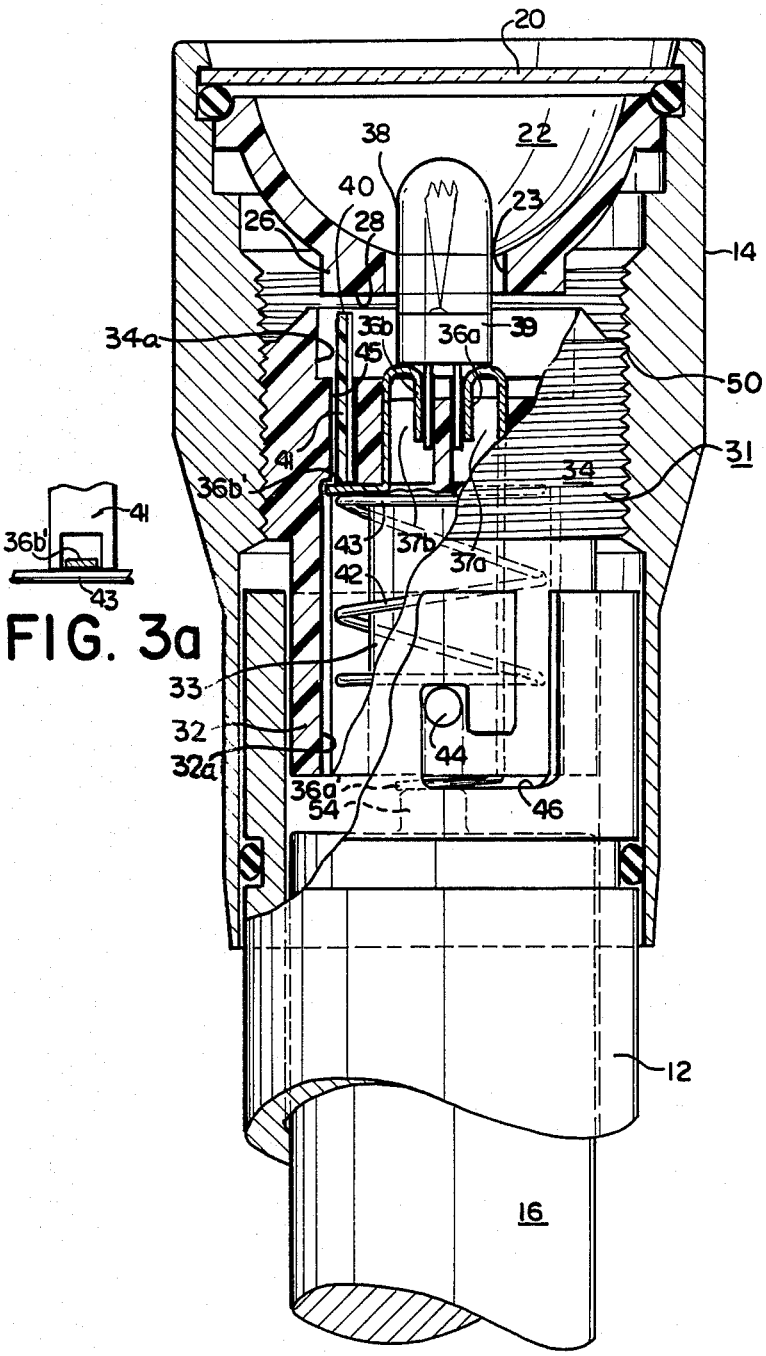
FIG. 3 is a cutaway view of a flashlight and socket/-switch assembly according to the present invention in a position wherein the electrical circuit is in the closed condition.
FIG. 3*a* is a partial view of the socket/switch assembly of FIG. 3 showing the relationship of the plunger, the spring, and the stationary contact when the electrical circuit is in the closed condition.
Figure 4A:
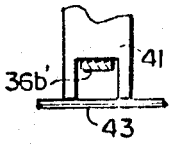
FIG. 4*a* is a partial view of the switch mechanism of the socket/switch assembly of FIG. 4 showing the relationship of the plunger, the spring, and the stationary contact when the electrical circuit is in the open condition.
Figure 4:
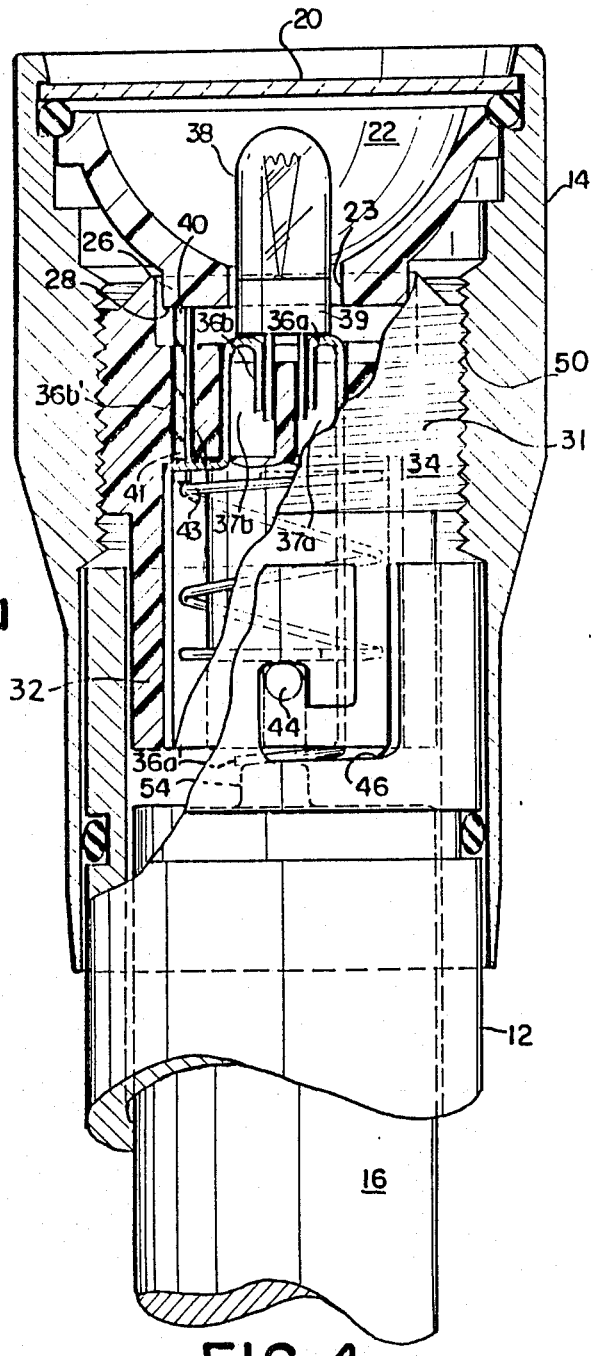
FIG. 4 is a cutaway view of the flashlight and socket/switch assembly shown in FIG. 3, in a position with the electrical circuit in the open condition.

The operation of the switching mechanism of the flashlight according to the present invention may be readily understood by referring to FIGS. 3 and 4. The head unit 14 is formed to engage with the socket/switch assembly 30 and to controllably translate axially relative thereto. To this end, head unit 14 includes internal threads 50 which are formed to mate with the threaded portion 34 of socket/switch body 31. Thus, when the internal threads 50 are engaged with the threaded portion 34, the head unit 14 can be translated axially along the socket/switch assembly 30 by rotating the head unit 14.

A collar 26 circumscribes the central opening 23 in parabolic reflector 22. The collar 26 has an annular surface 28 which faces the socket/switch assembly 30.

One leg of the electrical circuit for energizing the flashlight bulb 38 includes the spring contact **36*a* exposed in the hollow 34*a* adjacent the forward end of the assembly 30 and a stationary contact 36*a*′ supported in the stem 33 at the rearward end of the socket/switch assembly 30. The stationary contact 36*a*′ may be an extension of the spring contact 36*a* or may be electrically coupled thereto by other means known to those skilled in the art. The contact 36*a*′ is exposed at the center of the rearward end of the stem 33 so that a terminal 54 of the power cell 16 is maintained in intimate contact with the stationary contact 36*a*′ by the force of the spring 18 in the tail end of barrel 12**.

The other leg of the electrical circuit includes the spring contact **36*b* and a second stationary contact 36*b*′ disposed inside the socket/switch assembly 30. The stationary contact 36*b*′ may be an extension of the spring contact 36*b* or may be electrically coupled thereto by other means known to those skilled in the art. The coil spring 42 has an end coil 43 which is urged against the stationary contact 36*b*′ because the spring 42 is maintained in slight compression by the retaining pin 44**. The electrical circuit continues through the coil spring 42 to the retaining pin 44 and to the elongated barrel 12. Preferably, the barrel 12 is formed of an electrically-conductive material, thereby providing an electrical path to the other terminal of power cell 16.

The pin 44 provides an electrical path through the body 31 which need not be conductive and may be molded of plastic material. The spring 42 bears against the pin 44 to enhance the frictional retention of the pin 44 in the cylindrical portion 32 and stem 33.

When the coil spring 42 is in the position shown in FIG. 3, the electrical circuit is completed and the flashlight bulb 38 is lit. This is the normal condition of the electrical circuit.

The plunger 40 traverses through channel 45 in socket/switch body 31. As shown in FIG. 3*a*, the bifurcated end 41 of plunger 40 straddles the stationary contact 36*b*' to abut the end coil 43 of spring 42. The other end of plunger 40 projects axially from the channel 45.

When the head unit 14 is rotated so as to translate toward the barrel 12, the annular surface 28 enters the hollow 34*a* and butts up against the protruding end of plunger 40. As the head unit 14 continues to translate toward the barrel 12, the bifurcated end 41 of plunger 40 pushes on the end coil 43 of spring 42 and displaces it from the stationary contact 36*b*'. This relationship is shown most clearly in FIG. 4*a*. In this condition, the electrical path in the second leg is broken and the flashlight lamp 38 is de-energized.

The end coil 43 need only be displaced a very small distance in order to break the circuit. Consequently, switching of the flashlight is very quick and can be accomplished with only a very small fraction of a turn of the head unit 14. It is a feature and a distinct advantage of this invention that there is essentially no slack in the switching mechanism.

It is noted that FIG. 3*a* illustrates the narrow focused beam position of the parabolic reflector 22, when the filament of the bulb is positioned at the focal point of the parabolic reflector. When the reflector is displaced rearwardly, the beam widens until the bulb is de-energized by the plunger disengaging the spring 42 from the contact 36*b*'.

The spring 42 is significantly less stiff than the power cell retaining spring 18. The pressure necessary to maintain good contact between end coil 43 and stationary contact 36*b*' is significantly less than that necessary to maintain the power cells 16 in good contact with the socket/switch assembly 30. Accordingly, the socket/switch body 31 can be formed of a less rigid material than the barrel 12. The socket/switch body 31 is preferably formed of a plastic or resinous material such as that sold by E.I. du Pont de Nemours, Inc. under the trademark Delrin®.

Figure 5:
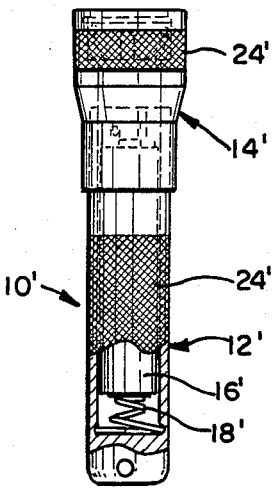
FIG. 5 is a partial cutaway view of a single power cell embodiment of the flashlight according to the present invention.

The present invention is also embodied in a single cell flashlight 10' as shown in FIG. 5. The smaller single cell flashlight 10' has a shortened barrel 12'. However, the head unit 14' is the same size as that in the double cell flashlight. The barrel 12' has only one open end and is long enough to hold a single power cell 16'. A socket/switch assembly 30' (not shown), similar to socket/switch assembly 30, couples the head unit 14' to the barrel 12'. Spring 18' is located in the completely closed-off tail end of barrel 12', and forces the power cell 16 against the socket/switch assembly 30' mounted in the open end of barrel 12'.

Some of the many novel features and advantages of the present invention are now apparent in view of the foregoing description. For example, a flashlight has been described in which the switching of the flashlight lamp is unrelated to the force necessary to maintain the power cells in contact with the switching mechanism. The use of a slightly compressed spring separate from the power cell retaining spring in the switching mechanism substantially reduces slack and thereby provides quicker switching of the flashlight lamp. Furthermore, the switching mechanism is easily installed and removed for replacement of the flashlight power cells.

A flashlight has been described in which the barrel has only one open end. The flashlight has no tail cap and thus, is more watertight than known flashlights because its tail end is completely closed off. Additionally, the flashlight according to the invention can be more economical to use since only one power cell is required, although multiple cells can be used.

It will be recognized by those skilled in the art that changes or modifications may be made to the above described embodiment without departing from the broad inventive concepts of the invention. It is understood, therefore, that the invention is not limited to the particular embodiments which are disclosed but are intended to cover all modifications and changes which are within the scope and spirit of the invention as defined in the appended claims.

What is claimed is:

1. A flashlight comprising:

a barrel for holding a power cell of the type having two terminals, said barrel having an open end;

a socket assembly for holding a light bulb, mounted on said barrel adjacent said open end and having first and second socket contacts for making electrical connection between the light bulb and said terminals;

spring means formed of an electrically conductive material and disposed in said socket assembly;

a stationary contact disposed within said socket assembly adjacent to one end of said spring means;

means for retaining said spring means in said socket assembly such that said spring means is urged toward said stationary contact so as to normally make an electrical connection therewith;

means for electrically connecting said stationary contact to one of the socket contacts;

an elongated plunger traversing through said socket assembly, said plunger having one end adapted to abut said spring means such that when said plunger is displaced to engage and displace said spring means, the electrical connection between said spring means and said stationary contact is broken, the other end of said plunger projecting from said socket assembly adjacent the light bulb;

means for retaining said socket assembly on said barrel;

a head unit formed to engage with said socket assembly, said head unit including a substantially parabolic reflector having a central opening to permit the light bulb to pass therethrough, said central opening being circumscribed by a collar having an annular surface facing said socket assembly, said collar being dimensioned and positioned to register with said plunger when said head unit is engaged with said socket assembly; and means for controllably translating said head unit axially relative to said socket assembly to engage and displace said plunger toward said spring means as said head unit is translated in one direction whereby electrical connection between said stationary contact and said spring means is broken.

2. A flashlight as recited in claim 1 further comprising:

a second stationary contact positioned on said socket assembly to make electrical contact with one of the terminals of the power cell when said socket assembly is mounted on said barrel; and means for electrically connecting said second stationary contact to the other of said socket contacts.

3. A flashlight as recited in claim 2 further comprising:

means for electrically connecting the other of the terminals of the power cell with said spring means.

4. A flashlight as recited in claim 2 wherein said means for retaining said spring means in said socket assembly comprises a generally cylindrical socket body having a metallic pin mounted diametrically therethrough to retain said spring means under compression, said pin projecting radially beyond said body to constitute means for electrically connecting the first stationary contact with the other of said power cell terminals.

5. A flashlight as recited in claim 4 wherein said socket body has a substantially cylindrical portion, said cylindrical portion having a diameter smaller than the open end of said barrel;

said barrel has an outer diameter and a pair of diametrically opposed bayonet slots formed adjacent to the open end; and said metallic pin has a length substantially equal to the outer diameter of said barrel such that the ends of said metallic pin extend beyond the cylindrical portion of said socket body;

whereby said socket assembly can be bayonet-mounted in the open end of said barrel.

6. A flashlight as recited in claim 5 wherein said barrel is open at one end and has an integral closure at the other end, the closed end having a spring element to bias said power cell into strict contact with said second stationary contact at the open end, said barrel and spring element being formed of electrically conductive material to provide electrical connection between said metallic pin and the power cell at the closed end of said barrel.

7. A flashlight as recited in claim 1 wherein said spring means comprises a coil spring, said socket assembly has an annular hollow to receive said coil spring, said stationary contact is disposed at one end of said annular hollow and the spring retaining means is located at the other end of said annular hollow so as to confine said coil spring under compression within said annular hollow.

8. A flashlight as recited in claim 1 wherein said socket assembly has an externally threaded portion; and said head unit has an internally threaded portion mating with the externally threaded portion of said socket assembly, whereby when said head unit is threaded onto said socket assembly, it translates axially relative to said socket assembly.

9. A flashlight as recited in claim 1 wherein said stationary contact is located at a position to engage the end of said spring means where said plunger abuts said spring means, and the end of said plunger which abuts the spring means is bifurcated so as to straddle said stationary contact, to enable the plunger to displace said spring means without displacing said stationary contact.

* * * * *